United States Patent [19]

Itaya et al.

[11] Patent Number: 4,870,464

[45] Date of Patent: Sep. 26, 1989

[54] SEPARATING/GUIDING DEVICE FOR AN ELECTRONIC COPYING MACHINE

[75] Inventors: Keiji Itaya, Yokohama; Makoto Tamura, Tokyo, both of Japan

[73] Assignee: Kabushiki Kaisha Toshiba, Kawasaki, Japan

[21] Appl. No.: 103,128

[22] Filed: Sep. 30, 1987

[30] Foreign Application Priority Data

Sep. 30, 1986 [JP] Japan ..... 61-231785
Dec. 30, 1986 [JP] Japan ..... 61-311859

[51] Int. Cl.[4] ..... G03G 15/00
[52] U.S. Cl. ..... 355/282; 355/290
[58] Field of Search ..... 355/3 FU, 23, 24; 271/207, 312, 900; 219/216

[56] References Cited

U.S. PATENT DOCUMENTS 3,913,521 10/1975 Bar-on ..... 219/216
4,065,120 12/1977 Imaizumi et al. ..... 271/900 X
4,281,623 8/1981 Kato et al. ..... 355/3 FU X
4,375,327 3/1983 Matsumoto et al. ..... 355/3 FU
4,391,509 7/1983 Cavagnaro ..... 355/3 FU X
4,475,804 10/1984 Kanno et al. ..... 355/3 FU
4,551,007 11/1985 Elter ..... 355/3 FU X

FOREIGN PATENT DOCUMENTS 58-60763 4/1983 Japan ..... 355/23

*Primary Examiner*—A. T. Grimley
*Assistant Examiner*—Ed Pipala
*Attorney, Agent, or Firm*—Cushman, Darby & Cushman

[57] ABSTRACT

A fixing device for use in a copying machine. The device has a heating roller, a pressure roller, and a separation pawl. The pawl has an end portion contacting the peripheral surface of the heating roller at a first point close to a second point where the pressure roller and the heating roller contact each other. The pawl separates a sheet, on which an image has been fixed, from the heating roller, and guides this sheet along a line tangent to the periphery of the heating roller and connected to the second point. The sheet is thus prevented from being deformed.

2 Claims, 8 Drawing Sheets

SEPARATING/GUIDING DEVICE FOR AN ELECTRONIC COPYING MACHINE

BACKGROUND OF THE INVENTION

The present invention relates to a fixing device adapted for an image forming apparatus, such as an electronic copying machine.

In fixing devices used in image forming apparatuses, such as an electronic copying machine, a sheet to which an image composed of developer is transferred is interposed between a heating roller and a pressure roller, whereby the image is fixed on the sheet. The fixed sheet is then separated from the heating roller by separating means, and is guided toward a sheet discharge roller.

As is shown in FIG. 1, sheet 8, to which an image composed of developer 4 (hereinafter called "toner image") has been transferred in a developing section (not shown), is conveyed by conveyor belt 6, and is then guided by guide 10 into the nip portion between heating roller 12 and pressure roller 14. Sheet 8 is fed between rollers 12 and 14, to fix the toner image thereon, and is then separated from heating roller 12 by separation pawl 16.

Separating pawl 16 is rotatably connected to stationary frame 18 by shaft 20. End portion 16*a* of pawl 16 is biased by spring 22 and contacts the peripheral surface of heating roller 12. Pawl 16 has guide portion 16*b* for guiding sheet 8 separated by portion 16*a* from heating roller 12. Sheet 8 guided by guide portion 16*b* of pawl 16 is guided by conveyor guide 24 toward a pair of sheet discharge rollers 26.

End portion 16*a* contacts the periphery of roller 12 at position B (hereinafter called "contact point") remote from position A (hereinafter called "nip point") where heating roller 12 contacts pressure roller 14. Pawl 16 has bent portion 16*c* connecting end portion 16*a* and guide portion 16*b*.

Since nip point A and contact point B are remote from each other, the end portion of sheet 8, which has passed from nip point A, warps upwardly, along heating roller 12, then is separated from roller 12, then warps downwardly as it is guided along bend portion 16*c* of separation pawl 16, and is finally guided toward discharge rollers 26. As a result, entire sheet 8 assumes a wavy shape as is shown in FIG. 2. Wavy sheet 8 is undesirable and raises some problems when it undergoes two copying processes in a copying machine in which this fixing device 2 is used. First, when such wavy sheets 8 are bundled together, the resultant bundle is inevitably thick. Secondly, sheet 8, which has become greatly wavy during the first copying process as it passes by fixing device 2, is wrinkled during the second copying process. Thirdly, wavy sheet 8 cannot readily be separated from the photosensitive drum of the copying machine.

SUMMARY OF THE INVENTION

The object of the present invention is to provide a fixing device for use in a copying machine, in which recording mediums do not become greatly wavy, whereby these mediums can be bundled together into a compact bundle, can be processed in double-side copying or repeated copying, without being greatly wrinkled, and can be smoothly separated from the photosensitive drum of the copying machine.

According to an aspect of the present invention, there is provided a fixing device comprising: backup means for backing up an image support having a toner image; cylindrical fixing means rotatably provided on said backup means, for fixing, while rotating, the toner image on the image support by pressing the image support onto said backup means; and separation means for separating the image support from said fixing means after the toner image has been fixed on the image support, and for guiding the image support along a line tangent to a first portion of said fixing means, which presses the image support onto said fixing means, said means having an end portion contacting a second portion of said fixing means, which is located close to said second portion of said fixing means.

DETAILED DESCRIPTION OF THE PREFERRED EMBODIMENTS

Figure 1:
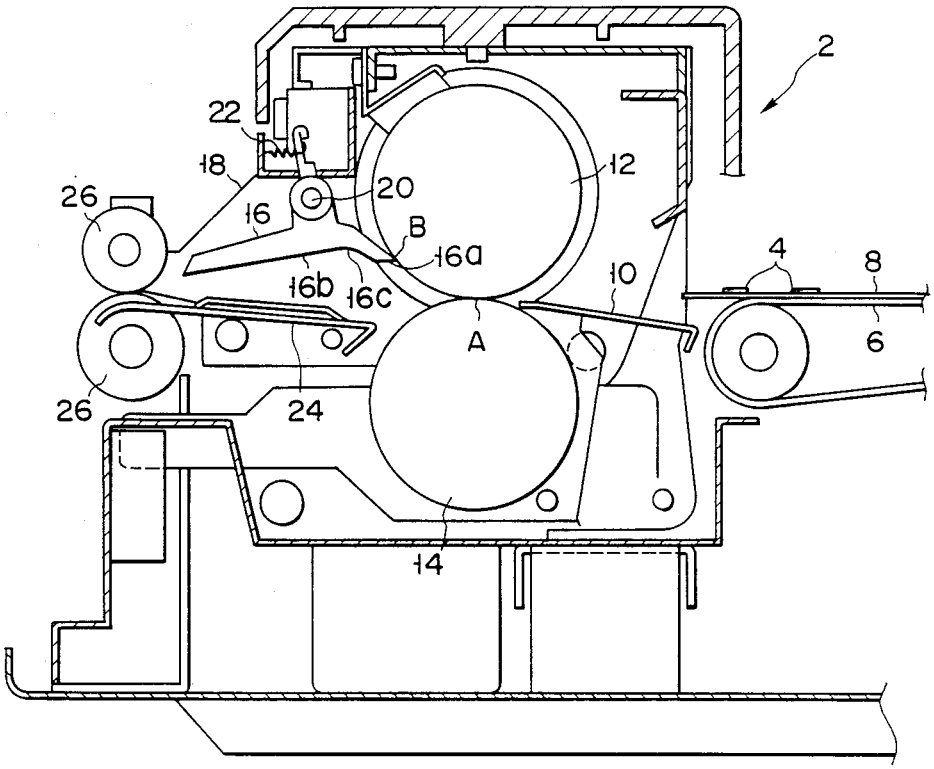
FIG.1 (PRIOR ART)
FIG. 1 is a sectional view showing a conventional fixing device.
Figure 2:
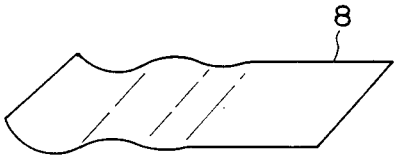
FIG.2 (PRIOR ART)
FIG. 2 is a perspective view showing a sheet fixed by the device in FIG. 1.
Figure 3:
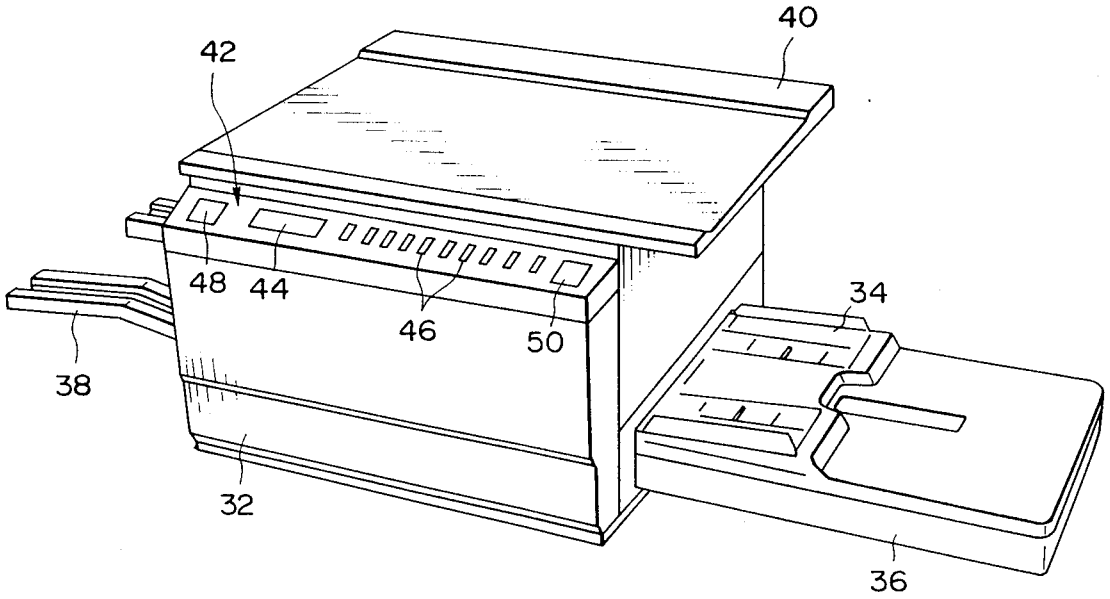
FIG. 3 is a sectional view showing an electronic copying machine using an embodiment of a fixing device according to the present invention.

FIG. 3 shows the external appearance of an electronic copying machine as an image forming apparatus which employs a fixing device according to the present invention. Reference numeral 32 denotes a housing. Sheet cassette 36 having manual guide 34 is attached to the left side of housing 32 in FIG. 3. Sheet tray 38 is attached to the left side of housing 32 in FIG. 3. Reciprocatingly movable original platen 40 is provided on the upper surface of housing 32. An operation display unit 42 is provided on the front side of the upper surface of housing 32. Indicator 44, ten keys 46, exposure setting control 48 and print key 50 are disposed on display unit 42.

Figure 4:
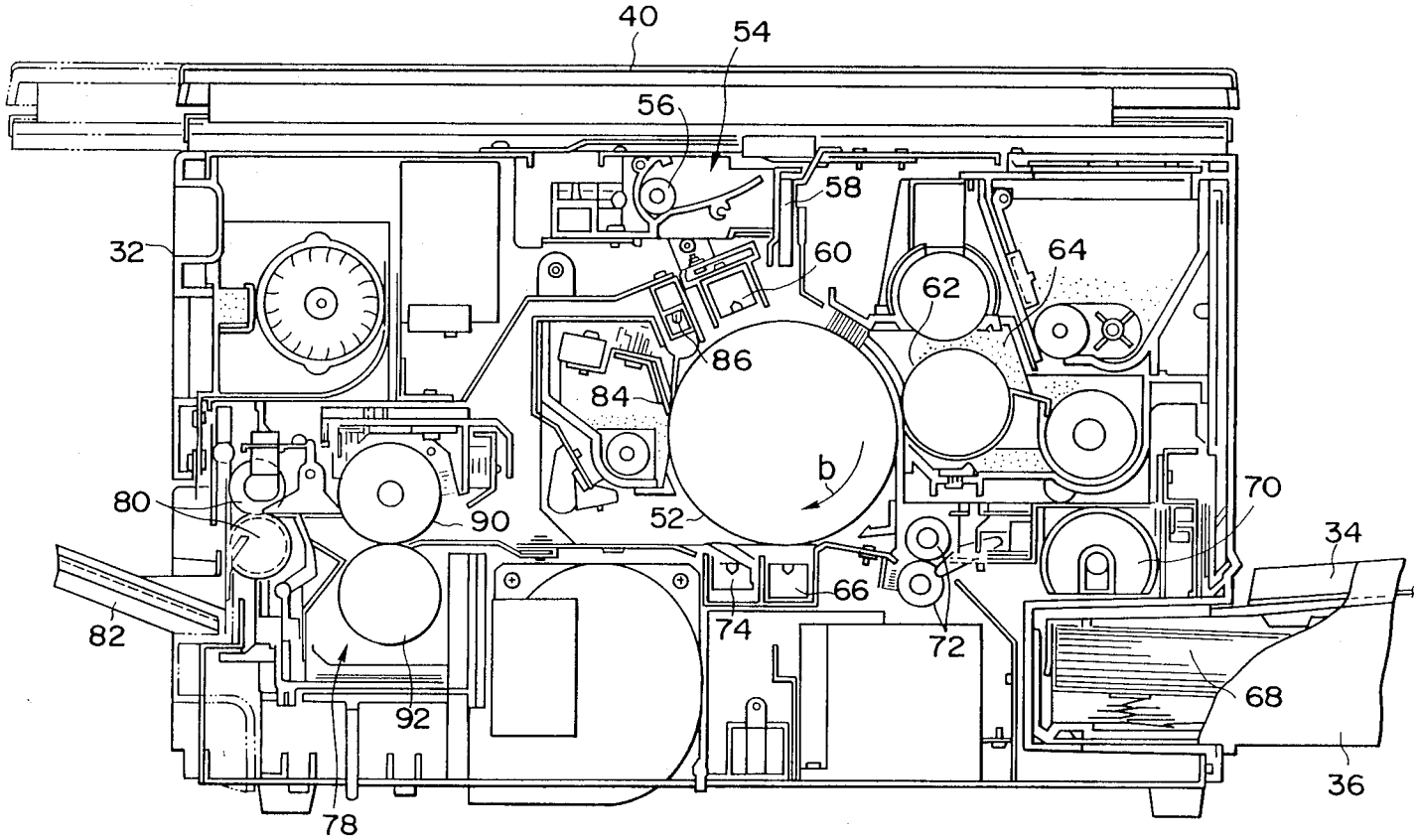
FIG. 4 is a sectional view schematically showing the internal structure of the device in FIG. 3.

In FIG. 4, photosensitive drum 52 is rotatably supported substantially at the center in housing 32. Photosensitive drum 52 is rotated in synchronism with original platen 40 by a drive mechanism (not shown) in the direction of arrow b. Exposure unit 54 is disposed between photosensitive drum 52 and original platen 40.

Exposure unit 54 has lamp 56 for illuminating an original on platen 40 and rod lens array or self focusing optical guide array, for example, Self Foc Lens Array (Trade Name) 58 for guiding and focusing light reflected from the original on photosensitive drum 52.

Upon rotation of photosensitive drum 52, the surface of photosensitive drum 52 is uniformly charged by electrostatic charger 60. The surface of photosensitive drum 52 is then exposed by exposure unit 54 to form an electrostatic latent image corresponding to an image of the original on the surface of photosensitive drum 52. The latent image is developed by adhering toner 64 thereto by developing device 62. Sheet 68 is fed by manual guide 34, or through sheet roller 70 and a pair of register rollers 72 from cassette 36, to a position between photosensitive drum 52 and transfer charger 66, in synchronism with that the image of toner 64 is opposed to transfer charger 66. The image of toner 64 is transferred onto sheet 68 by transfer charger 66. Transferred sheet 68 is separated from above photosensitive drum 52 by separation charger 74 by means of AC corona discharge, and then conveyed by conveyor, belt 76 (FIG. 5) to fixing device 78. The image of toner 64 is fixed in melting by fixing device 78, and sheet 68 is then discharged through a pair of upper and lower discharge rollers 80 onto sheet tray 82. After the image of toner 64 is transferred to sheet 68 and sheet 68 is then separated, remaining toner 64 on the surface of photosensitive drum 52 is cleaned by cleaning device 84. After cleaning, the surface potential of photosensitive drum 52 is eliminated by static elimination lamp 86 lower than a predetermined level, thereby preparing the next copy enabling state.

Figure 5:
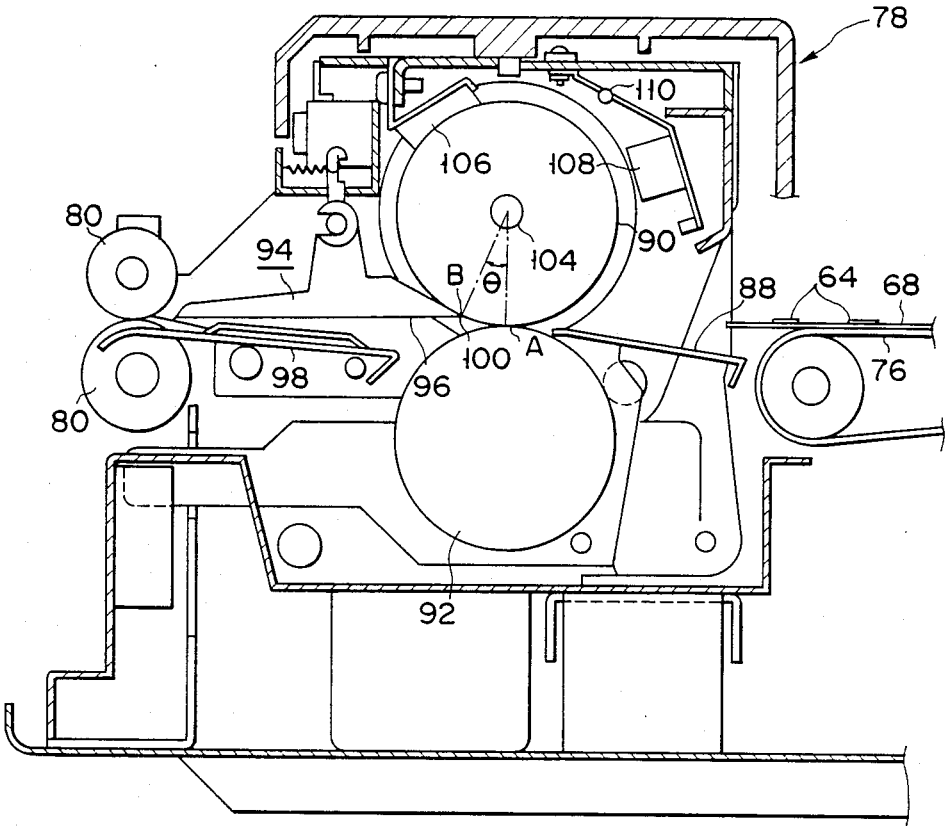
FIG. 5 is a sectional view showing a fixing device of the invention.

In fixing device 78, as shown in FIG. 5, sheet 68 conveyed by belt 76 is guided between heating roller 90 and pressure roller 92. When sheet 68 passes between heating roller 90 and pressure roller 92, the image of toner 64 is fixed to sheet 68. Fixed sheet 68 is separated by separation pawl 94 in contact with heating roller 90. Separated sheet 68 is guided by guide portion 96 of separation pawl 94 and guide 98 to a position between a pair of discharge rollers 80. Sheet 68 is discharged by discharge rollers 80 onto sheet tray 82.

Figure 6:
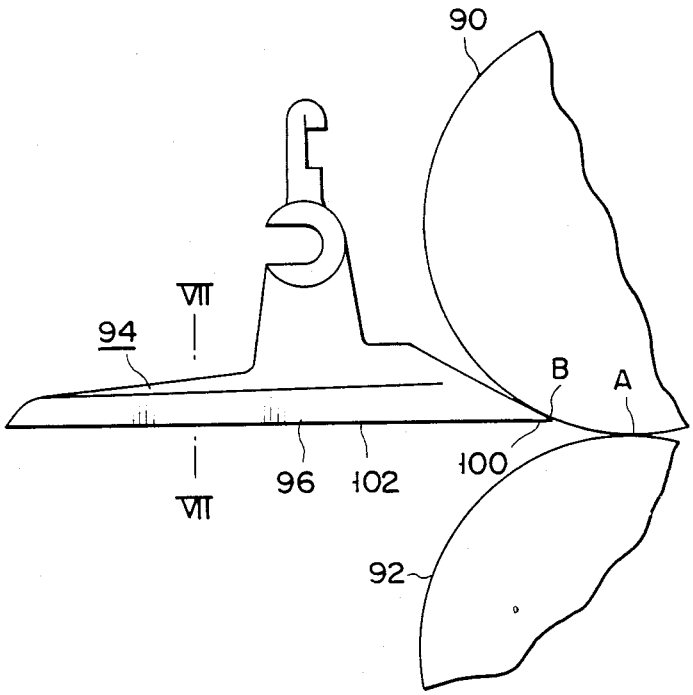
FIG. 6 is a view of the disposition of a separation pawl used in the fixing unit in FIG. 5.
Figure 7:
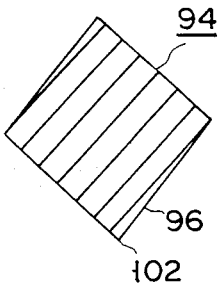
FIG. 7 is a sectional view taken along a line VII—VII of the separation pawl in FIG. 6.

Separation pawl 94 has, as shown in FIG. 6, an acute end 100 in contact with the peripheral surface of heating roller 90, and guide portion 96 formed continuously to end 100 for guiding sheet 68 separated by end 100. End 100 of pawl 94 is contacted at an angle $\theta$=less than 30° from a contacting point A between heating roller 90 and pressure roller 92 on the peripheral surface of heating roller 90, such as a portion within 10 mm therefrom. Guide portion 96 of pawl 94 is linearly formed from separating point B toward discharge rollers 80 at the down side of pawl 94. Thus, separated sheet 68 is guided by guide portion 96 along a tangential line passing contacting point A of heating roller 90 with pressure roller 92. In FIG. 7, the sectional shape of pawl 94 is formed in rhombic shape. Edge 102 is formed along the conveying direction of sheet 68 on a lower part of guide portion 96 in contact with sheet 68. Thus, since the contact of guide portion 96 with sheet 68 is reduced, the possibility of jams of sheet 68 due to contamination of pawl 94 can be reduced.

In FIG. 5, a releasable layer (not shown) made, for example, of fluorine resin is formed on the peripheral surface of heating roller 90. Heating roller 90 has heater lamp 104 contained therein. Lamp 104 heats the surface of the releasable layer to a predetermined temperature. Pressure roller 92 is biased under a predetermined pressure to heating roller 90 by a spring mechanism (not shown) to follow the movement of heating roller 90. Sheet 68 carrying the image of toner 64 is simultaneously affected by heat and pressure by passing between heating roller 90 and pressure roller 92, thereby fixing the image of toner 64 on sheet 68.

Separation pawl 94, cleaning felt 106 and temperature sensor 108 are disposed sequentially in the rotating direction of heating roller 90 from contacting point A, in contact with the peripheral surface of heating roller 90, on the periphery of heating roller 90. Cleaning felt 106 transfers on the surface of heating roller 90 to remove excessively adhered toner 64. Temperature sensor 108 detects the surface temperature of heating roller 90 to stop supplying of electric power, to heating lamp 104 by temperature fuse 110 during a malfunction. When sheet 68 is adhered to the surface of pressure roller 92, a pressure roller separation pawl (not shown) for separating sheet 68 is disposed on the periphery of pressure roller 92.

Figure 8:
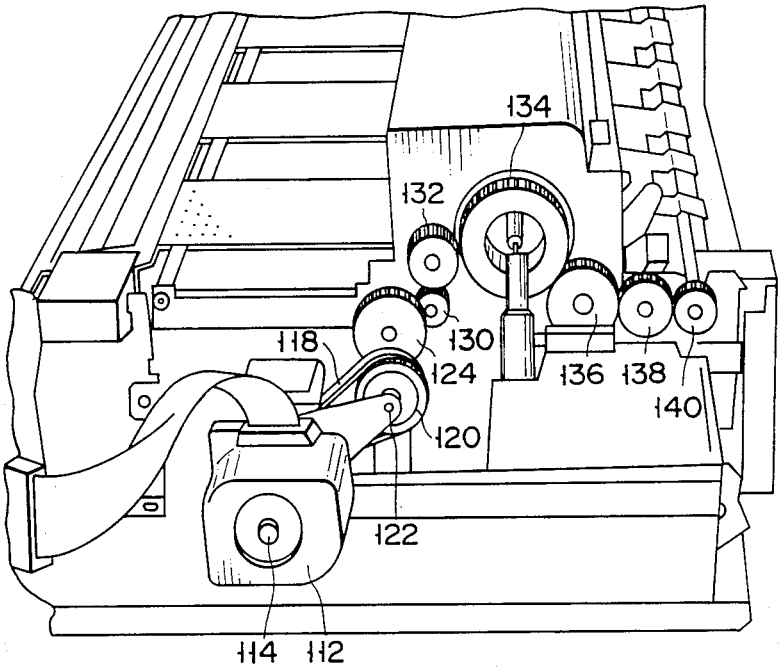
FIG. 8 is a perspective view showing a drive mechanism of the device in FIG. 5.
Figure 9:
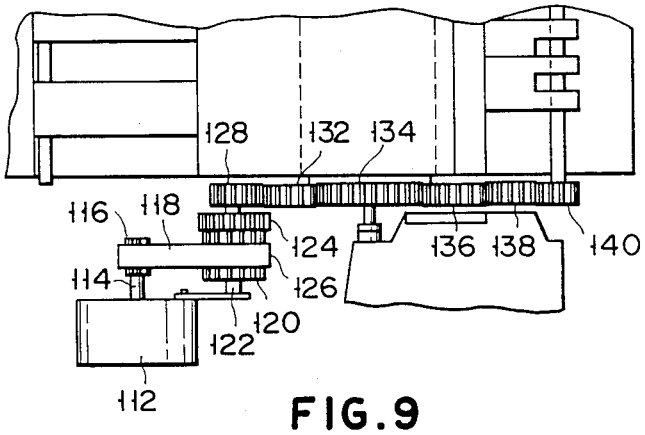
FIG. 9 is a perspective view showing a drive mechanism of the device in FIG. 5.

FIGS. 8 and 9 show a drive mechanism of heating roller 90. In FIGS. 8 and 9, reference numeral 112 denotes a motor for driving the heating roller. Motor 112 is, for example, a reversible pulse motor. First pulley 116 is fixed to the end of shaft 114 of motor 112. Timing belt 118 is engaged over first pulley 116. Timing belt 118 is also engaged over second pulley 120. A first gear (not shown) rotating integrally with second pulley 120 is fixed through rotational shaft 122 to second pulley 120. The first gear is engaged with second gear 124 in the upper portion. Third gear 128 rotating integrally with second gear 124 is fixed through rotational shaft 126 to second gear 124. Third gear 128 is engaged with fourth gear 130 at the side. Fourth gear 130 is engaged with fifth gear 132 in the upper portion. Fifth gear 132 is engaged with heating roller drive gear 134 for rotating heating roller 90. With this construction, the rotation from motor 112 is transmitted to heating roller 90. Sixth gear 136, seventh gear 138 and discharge roller gear 140 are sequentially engaged in this order with heating roller drive gear 134. Thus, discharge rollers 80 are rotated upon rotation of heating roller 90.

Figure 10:
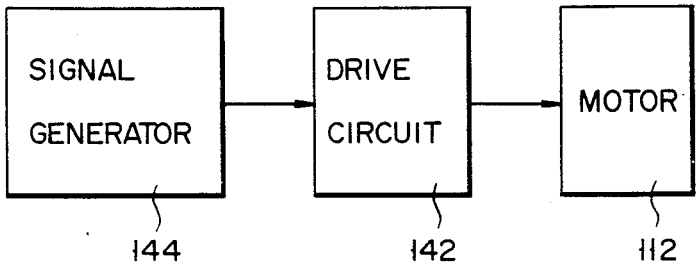
FIG. 10 is a view showing the drive circuit of the drive mechanism.
Figure 11:
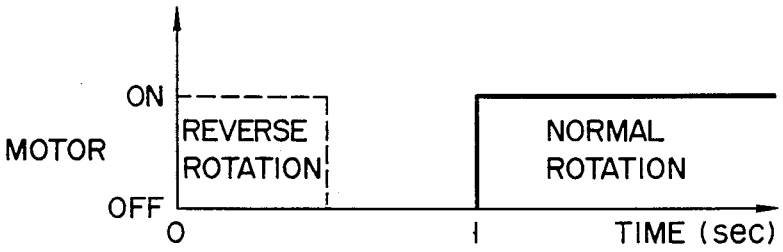
FIG. 11 is a view showing the operation timing of the drive mechanism.

Motor 112 is coupled, as shown in FIG. 10, through drive circuit 142 to rotating direction switching signal generator 144. A signal from rotating direction switching signal generator 144 is fed to drive circuit 142. Drive circuit 142 rotates motor 112 normally or reversely, based on the signal from the generator 144. In FIG. 11, upon starting of copying, a reverse rotation signal is output from rotating direction switching signal generator 114 to rotate heating roller 90 reversely until arriving at a predetermined rotating angle. Thereafter, rotating direction switching signal generator 144 outputs a normal rotation signal to rotate heating roller 90 in normal direction (ordinary direction). The reverse rotating angle of heating roller 90 is set to a range more than the rotating angle corresponding to the length of slidably contacting heating roller 90 with cleaning felt 106 and less than the rotating angle corresponding to the length of the circumference immediately before arriving at contacting point A of heating roller 90 with pressure roller 92 from the slidable contact of heating roller 90 with cleaning, felt 106.

A reverse rotating signal from rotating direction switching signal generator 144 is fed to drive circuit 142 upon the starting of copying before the normal rotating operation of heating roller 90, started after a predetermined time upon starting of copying to reversely rotate motor 112. Thus, heating roller 90 is rotated counterclockwise in FIG. 5, i.e., reverse to the normal rotating direction. Heating roller 90 is stopped when the surface of heating roller 90, immediately after passing cleaning felt 106 in the previous copying step, has passed cleaning felt 106 by the reverse rotation of heating roller 90. Then, a normal rotation signal is output from rotating direction switching signal generator 144, and heating roller 90 is rotated clockwise in FIG. 5. Sheet 68 carrying the image of toner 64, conveyed by belt 76 is interposed and conveyed between heating roller 90 and pressure roller 92, heat and pressure are simultaneously applied thereto to fix the image of toner 64 on sheet 68. Then, sheet 68 is separated by separation pawl 94 from heating roller 90, and guided toward discharge rollers 80.

Figure 12:
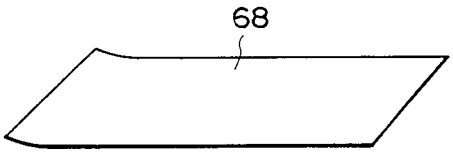
FIG. 12 is a perspective view showing a sheet fixed by the device of FIG. 5.

With the above construction, separation pawl 94 is contacted with the peripheral surface of heating roller 90 at the position that the end of pawl 94 approaches contacting point A of heating roller 90 with pressure roller 92, and guide portion 96 of pawl 94 is linearly formed toward a pair of discharge rollers 80. Therefore, the end of sheet 68 which has passed contacting point A of heating roller 90 with pressure roller 92 is separated from the surface of heating roller 90 without almost bending by end 100 of pawl 94, and then guided by guide portion 96 substantially along a tangential line passing contacting point A of heating roller 90 with pressure roller 92. Thus, discharged sheet 68 is less deformed as shown in FIG. 12 . Therefore, when such sheets 68 are bundled, they do not become bulky. Thus, the stacking property of sheets is improved.

Since heating roller 90 is rotated at a predetermined angle before starting the fixing operation, of toner 64, excessive toner 64 melted, dropped and adhered to the surface of heating roller 90 is reliably removed by cleaning felt 106. Therefore, sheet 68 is prevented from being contaminated on the back surface. Further, the replacement cycle of cleaning felt 106, heating roller 90 and pressure roller 92 can be lengthened.

Figure 13:
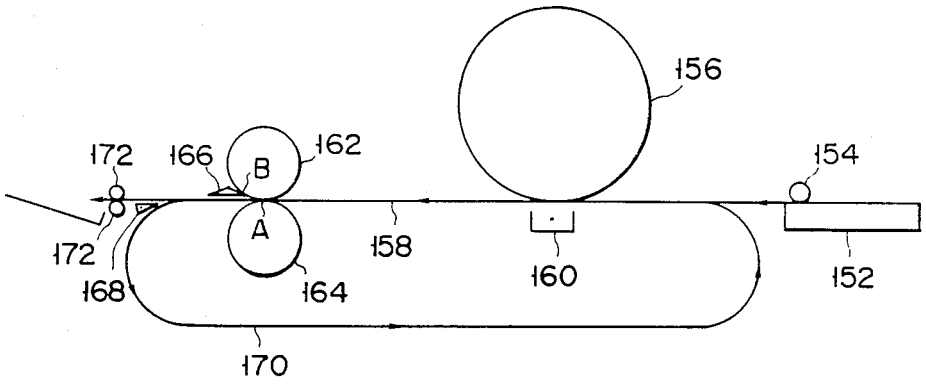
FIG. 13 is a view schematically showing a both-side copying machine using a fixing device according to the invention.

FIG. 13 shows a modified embodiment of the fixing device used for a both-side copying machine according to the invention. In the modified embodiment, a sheet fed by feed roller 154 from sheet cassette 152 is conveyed along main conveyance passage 158 toward photosensitive drum 156. First toner image is transferred by transfer charger 160 from photosensitive drum 156 to one side surface of the sheet. Then, first toner is fixed to the sheet by heating roller 162 and pressure roller 164. Thereafter, the sheets are separated by separation pawl 166 from heating roller 162, and the sheets are then sorted from main conveyance passage 156 to return passage 170. Return passage 170 is branched from main conveyance passage 158 between fixing roller 162 and discharge rollers 172, and combined with main conveyance passage 158 between sheet cassette 152 and transfer charger 160. The sheet is again fed, through return passage 170, to a position between photosensitive unit 156 and transfer charger 160, and second toner image is transferred to the other side surface of the sheet. Then, the second toner image is fixed to the sheet by heating roller 162 and pressure roller 164. Thereafter, the sheet is separated by separation pawl 166 from heating roller 162, and then discharged by discharge rollers 172 onto sheet tray 174.

Figure 14:
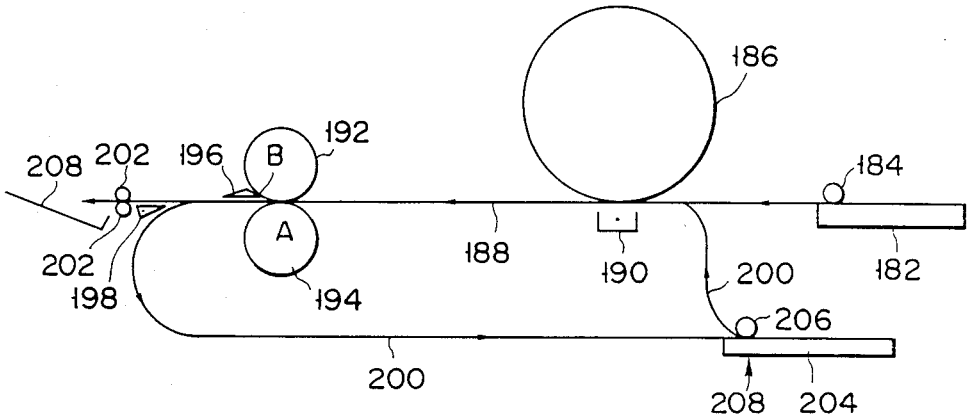
FIG. 14 is a view showing a multiplex copying machine using the fixing device of the invention.

FIG. 14 shows another modified embodiment of a fixing device according to the invention used for a copying machine. In this modified embodiment, the sheet fed by feed roller 184 from sheet cassette 182 is conveyed along main conveyance passage 188 toward photosensitive drum 186, a first toner image is transferred from photosensitive drum 186 to one side surface of the sheet by transfer charger 190. Then, the first toner image is fixed to the sheet by heating roller 192 and pressure roller 194. The sheet is then separated from heating roller 192 by separation pawl 196, and sorted from main passage 188 to return passage 200. Return passage 200 is branched from main passage 188 between heating roller 192 and discharge roller 202, and combined to main passage 188 between sheet cassette 182 and transfer charger 190. An inverting portion 208 having temporary retainer 204 and feed roller 206 is provided on the way of return passage 200. After the sheet is temporarily retained at temporary retainer 204 through return passage 200, the sheet is fed from the temporary retainer 204 by feed roller 206. Thus, the sheet conveying direction is converted. The sheet is fed through return passage 200 to a position between photosensitive drum 186 and transfer charger 190, and the second toner image is transferred to be superposed on the first toner image on the one side surface of the sheet. Then, second toner image is fixed to the sheet by heating roller 192 and pressure roller 194. Thereafter, the sheet is separated by separation pawl 196 from heating roller 192, and discharged by discharge rollers 202 onto sheet tray 208.

Thus, copying processes are performed twice in a both-side copying machine and a multiple copying machine Since the sheet is not deformed in the case of passing the fixing device in the first copying process, the sheet is not wrinkled nor is the sheet insufficiently separated from photosensitive drum, 156, 186 to prevent the sheet from being jammed, in the case of a second copying process.

When the distance between contacting point A of heating roller 162, 192 with pressure roller 164, 194 and separating point B of contacting point of separation pawl 166, 196 from heating roller 162, 192 was set to 15 mm, the wrinkle occurrence rate of the sheet is 100%, and the jam occurrence of sheet on photosensitive drum 156, 186 is 30%. When the distance was set to 8 mm, the wrinkle occurrence rate is 30%, and the jam occurrence rate is 0%. When the distance was set to 5 mm, the wrinkle occurrence rate is 0% and the jam occurrence rate is 0%.

In the embodiments described above, the fixing device having a heating roller and a pressure roller to fix toner image by heat and pressure on a sheet is provided. In this constriction, the separation pawl is contacted with the heating roller. However, affixing device having a pair of pressure rollers with the toner image fixed to the sheet by the pressure can also be employed, and the separation pawl may be attached to at least one of the pressure rollers. The fixing device also has a roller and a backup body for pressing the sheet to the roller, and the separation pawl may be contacted with the roller.

What is claimed is:

1. A copying apparatus comprising:

means for forming an image on an image support;

means for fixing the image to the image support, said fixing means having a rotatable heating member for heating the image support and a rotatable pressing member contacting said heating member so as to transport the image support via the rotation of said members along a line tangent to a first portion of said fixing means, said image being formed on that side of the image support which faces said heating member;

means for separating the image support from the surface of said heating member after the fixing has been carried out by said fixing means, said separating means having an end portion contacting a second portion of said fixing means located at a distance of less than 10 mm from the first portion of said fixing means, and having a guide portion linearly extending substantially along a tangential line passing the contact portion;

means, opposing and cooperating with said separating means, for linearly guiding the image support separated by said separating means; and means for returning the image support guided through said guiding means between said heating member and said pressing member so as to perform copying on both sides of a sheet.

2. A copying apparatus comprising:

means for forming an image on an image support;

means for fixing the image to the image support, said fixing means having a rotatable heating member for heating the image support and a rotatable pressing member contacting said heating member so as to transport the image support via the rotation of said members along a line tangent to a first portion of said fixing means, said image being formed on that side of the image support which faces said heating member;

means for separating the image support from the surface of said heating member after the fixing has been carried out by said fixing means, said separating means having an end portion contacting a second portion of said fixing means set apart from the first portion of said fixing means by an angular interval of 30°, and having a guide portion linearly extending substantially along a tangential line passing the contact portion;

means, opposing and cooperating with said separating means, for linearly guiding the image support separated by said separating means; and means for returning the image support guided through said guiding means between said heating member and said pressing member so as to perform copying on both sides of a sheet.

* * * * *